US011795616B2

(12) United States Patent
Lindblom et al.

(10) Patent No.: US 11,795,616 B2
(45) Date of Patent: Oct. 24, 2023

(54) BLADE FOR A REFINER

(71) Applicant: VALMET AB, Sundsvall (SE)

(72) Inventors: Thommy Lindblom, Hägersten (SE); Marcus Sjölund, Hägersten (SE)

(73) Assignee: VALMET AB, Sundsvall (SE)

( * ) Notice: Subject to any disclaimer, the term of this patent is extended or adjusted under 35 U.S.C. 154(b) by 358 days.

(21) Appl. No.: 17/149,995

(22) Filed: Jan. 15, 2021

(65) Prior Publication Data

US 2021/0254282 A1 Aug. 19, 2021

(30) Foreign Application Priority Data

Feb. 17, 2020 (SE) ..... 2050170-6

(51) Int. Cl.
*D21D 1/30* (2006.01)
*B02C 7/12* (2006.01)

(52) U.S. Cl.
CPC ..... *D21D 1/306* (2013.01); *B02C 7/12* (2013.01); *D21D 1/303* (2013.01)

(58) Field of Classification Search
CPC ..... D21D 1/306; D21D 1/303; D21D 1/30; D21D 1/006; B02C 7/12
USPC ..... 241/261.3
See application file for complete search history.

(56) References Cited

U.S. PATENT DOCUMENTS 2,651,976 A * 9/1953 Sutherland ..... D21D 1/30 241/296
11,162,220 B2 * 11/2021 Singhal ..... D21D 1/303
2019/0301097 A1 * 10/2019 Gingras ..... B02C 7/12

* cited by examiner

*Primary Examiner* — Katrina M Stransky
*Assistant Examiner* — Teresa A Guthrie
(74) *Attorney, Agent, or Firm* — Foley & Lardner LLP

(57) ABSTRACT

The present invention relates to a blade for a disc refiner intended for refining lignocellulosic material, the blade (10) comprising a surface (1) delimited by an inner circumference (11) and an outer circumference (12), a refiner zone (2) on the surface (1) for refining lignocellulosic material, a blank zone (3) on the surface (1), wherein the refiner zone (2) is arranged closer to the inner circumference (11) than the blank zone (3), the blade (10) further comprising a separation groove (4) that is arranged between the refiner zone (2) and the blank zone (3), and at least one connecting groove (5) that connects the separation groove (4) to the outer circumference (12) of the blade (10) across the blank zone (3).

Figure 1:
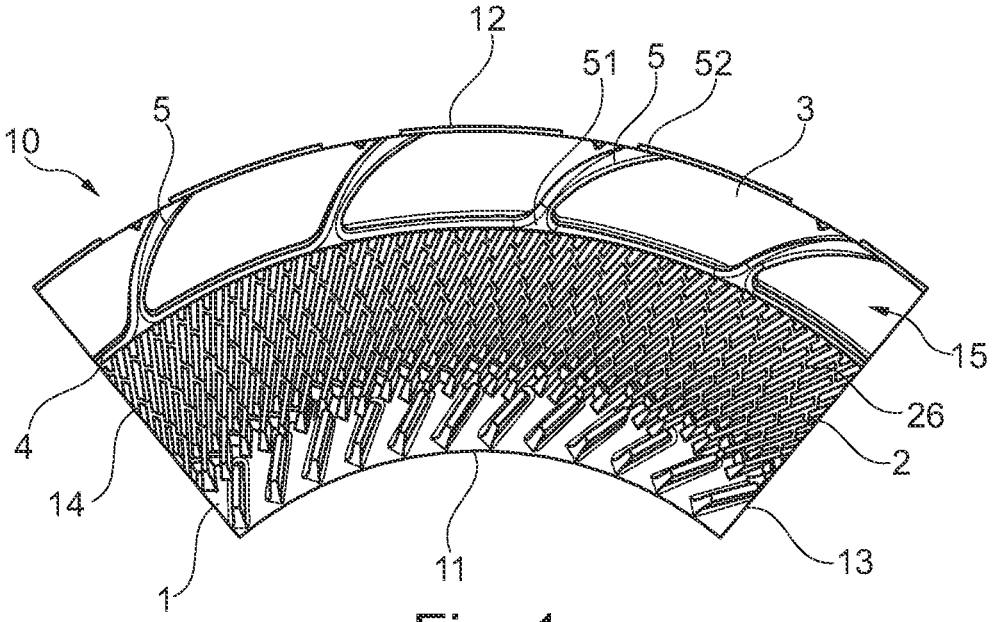

The invention also relates to a blade pair and to a refiner comprising at least one blade.

14 Claims, 4 Drawing Sheets

BLADE FOR A REFINER

TECHNICAL FIELD

The present invention relates to a blade for a disc refiner intended for refining lignocellulosic material, the blade comprising

- a surface delimited by an inner circumference and an outer circumference,
- a refiner zone on the surface for refining lignocellulosic material,
- a blank zone on the surface, wherein the refiner zone is arranged closer to the inner circumference than the blank zone. The invention also relates to a blade pair with a rotor side blade and a stator side blade, and to a refiner comprising at least one blade.

BACKGROUND

A disc refiner is commonly used within the pulping industry for refining lignocellulosic material used in the production of fibrous material such as paper and board.

The disc refiner comprises two or more opposite refining elements, at least one of which is rotatable. The rotating refining element can be referred to as a rotor or a rotor side blade, whereas the non-rotating or stationary refining element can be referred to as a stator or a stator side blade. Between the refining elements is a refining gap, where the material to be refined is ground against the refining surfaces. The refining surface of the refining elements comprises blade bars and blade grooves that serve to refine the lignocellulosic material during use.

In some applications, the rotor side blade and the stator side blade are circular blades that are mounted on one stationary and one rotary frame element in the refiner, such that they face each other during use. Often, the stator side blade and the rotor side blade are divided into many smaller blade segments that each cover a sector of the frame element and that when mounted together form the circular blades. There is generally an opening at the center of at least one of the circular blades for insertion of the lignocellulosic material, such that the material enters at the center and is subsequently transported in a radial direction during refining.

In some disc refiners, the refining surfaces on the blade do not cover the entire area of the frame element but instead only a smaller circle of the frame element such that the blade or plurality of blade elements also have a blanked surface placed radially outside the refining surface. This type of blade or plurality of blade segments are generally referred to as a blanked blade or blanked blade segments.

One problem associated with blanked blades or blanked blade segments is that a build-up of material sticking to the blanked surface occurs. The build-up often comprises resin from the lignocellulosic material and acts to decrease performance of the refiner. When the refined lignocellulosic material passes along the blanked surface, particles from the build-up come loose and is mixed into the material as it passes to subsequent process stages. The build-up is sticky and dark and results in dark spots in the end-product (i.e. paper or board).

To avoid this, and in view of the difficulty in removing the build-up from the refined blade or refiner blade segments, the blade or blade segments need to be replaced as soon as the build-up has occurred. This results in increased costs due to the shortened lifespan of the refiner blades and to the need to remove any end product that contains the dark spots.

Currently, there are no known devices or methods for eliminating this problem in a satisfactory way. There is therefore a need for an improved refiner or refiner blade(s) that can decrease or eliminate the build-up on the blanked surface.

SUMMARY

The object of the present invention is to eliminate or at least to minimize the problems discussed above. This is achieved by a blade for a disc refiner, a blade pair for a disc refiner, and a refiner for refining lignocellulosic material according to the appended independent claims.

The blade according to the invention comprises a surface delimited by an inner circumference and an outer circumference, a refiner zone on the surface for refining lignocellulosic material and a blank zone on the surface, wherein the refiner zone is arranged closer to the inner circumference than the blank zone. The blade further comprises a separation groove that is arranged between the refiner zone and the blank zone on the surface, and at least one connecting groove that connects the separation groove to the outer circumference of the blade across the blank zone.

By providing the separation groove and the connecting groove, the lignocellulosic material is transported with increased efficiency and the pressure at the blank zone is increased as compared to prior art blades. This decreases the deposit of particles from the lignocellulosic material on the blade so that the lifetime of the blade is increased while at the same time preventing build-up of resin that could come loose and be included in the finished paper or board product. It is advantageous to manage the pressure between the blade and a corresponding blade in a blade pair in order to avoid a sharp pressure drop as the lignocellulosic material progresses from the refiner zone to the blank zone. This decreases the risk of resin particles in the lignocellulosic material condensing and attaching themselves to the blank zone so that the build-up is created. More particularly, by controlling a gap between the blank zones of the blades in the blade pair the pressure that is extremely high in an operating gap between the refiner zones can be lowered in a controlled way so that lignocellulosic material and steam is transported in an efficient way without resulting in build-ups of substances in the blank zone. Controlling the pressure will also enable controlling the temperature so that the very high temperature that the lignocellulosic material is subjected to in the operating gap is gradually lowered as the material progresses across the blank zone. The separation groove provides an increase in the gap between the blades immediately outside of the refiner zone, so that newly refined material is subjected to a pressure drop of a controlled magnitude before progressing across the blank zone. The at least one connecting groove in turn may transport steam while the lignocellulosic material passes the blank zone on an upper surface of the blank zone.

Suitably, the blade further comprises a plurality of connecting grooves, each being arranged to connect the separation groove to the outer circumference of the blade across the blank zone. This further improves the transport of lignocellulosic material and the prevention of a build-up on the blank zone. It is advantageous for the connecting grooves to be spaced out along the blade so that they occur at regular intervals in order to further increase the transport of lignocellulosic material.

The at least one connecting groove may have a first connecting point at the separation groove and a second connecting point at the outer circumference, and the second connecting point may be offset from the first connecting point in a circumferential direction. This allows for material being transported in the connecting groove from the separation groove towards the outer circumference, and by providing the offset the transport is facilitated when the refiner is in operation so that a rotor side blade is rotating.

In order to control the pressure, it is advantageous to provide the grooves as described above and also to avoid the height of the blank zone from differing much from a bar height of the refiner zone, so that a resulting gap between opposing blades in the disc refiner can be kept sufficiently small. Since the refiner zone is subjected to considerable wear during use, the height of the blank zone should suitably be adapted so that the refiner zone can be worn down a specified wear height without the blank zone contacting a corresponding blank zone on the opposing blade.

Suitably, the surface forms a plane across the blade and the separation groove and the at least one connecting groove extend from an upper surface towards the plane of the surface. Further, the separation groove and the at least one connecting groove may suitably have a depth that is at least half a distance from the upper surface to the plane. Thereby, the separation groove is deep enough to extend at least half the bar height and thus provide a larger distance to a corresponding blade of a blade pair when the blade is in use in a refiner so that the pressure is lowered as the lignocellulosic material passes from the refiner zone to the blank zone. By the at least one connecting groove also having a depth of at least half the distance to the plane of the surface, steam can more easily be transported across the blank zone whereas the lignocellulosic material can be transported on an upper surface of the blade.

The depth of the separation groove and/or the at least one connecting groove may be at least a distance from the upper surface to the plane, i.e. at least a bar height of the refiner bars of the refiner zone. Thereby, a larger distance to a corresponding blade can be achieved, giving a more marked lowering of pressure when the blade is in use.

Suitably, the refiner zone comprises a plurality of refiner bars that extend a bar height from a plane of the surface.

The blank zone may have a height from the surface to an upper surface and the height may be a variable height that varies across the blank zone. Thereby, the distance from the surface up to the upper surface may be varied so that the gap between the blade and a corresponding blade is also varied when the blade is mounted in a refiner. By being able to vary the gap a greater degree of control over the pressure in the gap during use and thereby also of the temperature in the gap during use is achieved so that deposits of material or build-up of resins and the like from the lignocellulosic material on the blade is minimized or even eliminated.

Suitably, a maximum value of the height is at an inner segment of the blank zone and the height decreases in at least one part of the blank zone from the inner segment towards the outer circumference of the blade. Thereby, the distance from the blade to the corresponding blade can be gradually increased so that the pressure is gradually lowered in the gap as the lignocellulosic material passes from the refiner zone towards the outer circumference.

Alternatively, a maximum value of the height is at an outer segment of the blank zone and the height decreases in at least one part of the blank zone from the outer segment towards the separation groove. Thereby, the distance from the blade to a corresponding blade can be gradually decreased from the refiner zone towards the outer circumference. This may be advantageous in increasing the pressure once the lignocellulosic material has passed into the blank zone so that the pressure when the material exits the gap at the outer circumference may be higher than at some point closer to the refiner zone.

In some embodiments, the blade may be mounted together with a corresponding blade that is shaped so that the gap is kept constant despite variations in height on the blade, or that the size of the gap is controlled depending on how the pressure and temperature should vary across the blank zone in order to facilitate or even optimize transport from the refiner zone to the outer circumference.

Suitably, the blank zone has a height from the surface to an upper surface and the height is smaller than the bar height by at least a wear height. Thereby, the refiner bars of the refiner zone can be worn down without the blank zone contacting the opposing blade, while still avoiding a sharp pressure drop that would occur if the gap between the opposing blades were much larger at the blank zone than at the refiner zone.

Suitably, the blade is a blade segment in form of a sector delimited by the outer circumference, inner circumference, a first side edge and a second side edge. A plurality of blade segments may serve to form a circular blade. By providing the circular blade in the form of segments the transporting, handling and mounting of the blade in the refiner is facilitated, and the lifespan of the circular blade may also be increased by replacing only those segments that are too worn to be used or that have become defective without affecting the other segments of the circular blade.

Also provided according to the invention is a blade pair with a stator side blade for mounting on a stator side of a refiner, and with an additional rotor side blade for mounting on a rotor of a refiner. Each of the blades comprise a surface delimited by an inner circumference and an outer circumference, a refiner zone on the surface for refining lignocellulosic material, a blank zone on the surface, wherein the refiner zone is arranged closer to the inner circumference than the blank zone, and wherein at least one of the stator side blade and the rotor side blade comprises a separation groove that is arranged between the refiner zone and the blank zone and that extends in a circumferential direction, and at least one connecting groove that connects the separation groove to the outer circumference of the blade across the blank zone. This provides the advantages given above with reference to the blade for a disc refiner according to the invention.

Suitably, the blank zone has a height from the surface to an upper surface and wherein the height is smaller than a bar height of refiner bars in the refiner zone by at least a wear height. Thereby, the refiner bars can be worn down without the blank zone contacting the blank zone of the other blade so that the lifetime of the blade pair is increased.

The stator side blade may have a height in the blank zone and wherein the rotor side blade has a second height in the blank zone, and wherein a sum of the height at one point and the second height at a corresponding point does not differ more than two times a bar height of refiner bars in the refiner zone, preferably not more than 1.5 times a bar height and more preferably not more than the bar height, from a sum of the height at any other point of the blank zone on the stator side blade and the second height at a corresponding point of the rotor side blade, wherein a corresponding point is a point on the rotor side blade that is closest to the point on the stator side blade when the rotor side blade is at rest. Thereby, the pressure may be controlled during use so that no great variations or sharp drops occur.

Also provided according to the invention is a refiner comprising at least one blade according to the invention.

Suitably, the at least one blade is a stator side blade that is arranged on a stator side in the refiner, and the refiner further comprises at least one rotor side blade that is arranged on a rotor side in the refiner. The rotor side blade suitably comprises a surface delimited by an inner circumference, an outer circumference, a refiner zone on the surface for refining lignocellulosic material, and a blank zone on the surface, wherein the refiner zone is arranged closer to the inner circumference than the blank zone, and wherein the at least one rotor side blade is arranged opposite the at least one stator side blade in such a way that a gap is formed between the blades. Suitably, the gap between the blank zone of the stator side blade and the blank zone of the rotor side blade is at least one fifth of a bar height of refiner bars in the refiner zone and not more than the bar height. Thereby, the gap is of suitable dimensions to allow for an increase in the gap in the blank zone as compared with the operating gap in the refiner zone, but the gap is not large enough to give rise to a lowering of pressure and temperature that would result in deposits or build-up of material on the blades in the blank zone.

The gap may advantageously be 0.4-0.6 times the bar height, preferably about 0.5 times the bar height to further increase these benefits.

Suitably, the rotor side blade may also be a blade according to the present invention and have the same features as the stator side blade as described above.

Many additional benefits and advantages of the present invention will be readily understood by the skilled person in view of the detailed description below.

DRAWINGS

Figure 2:
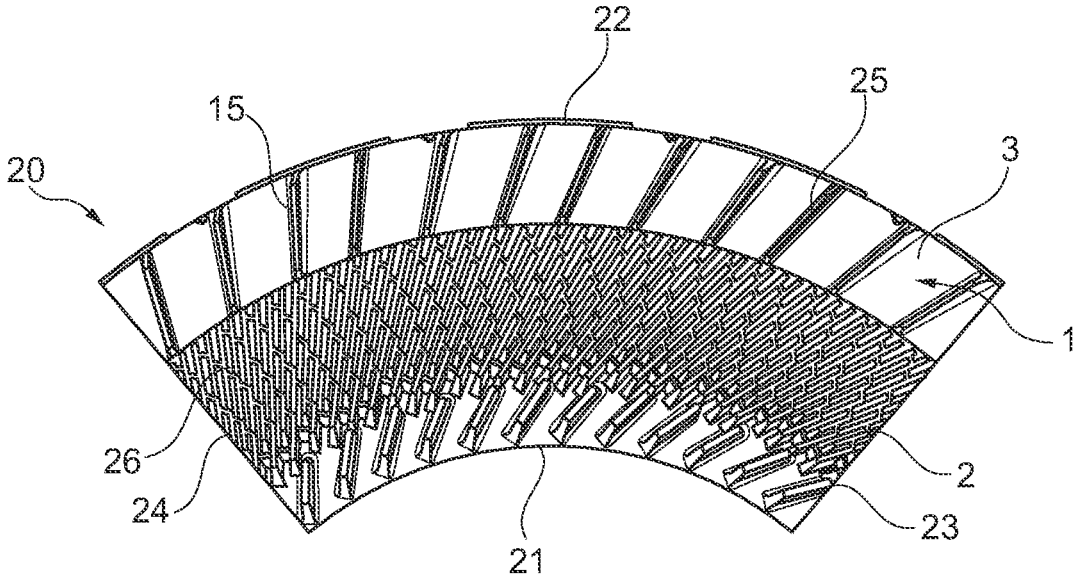
Figure 3:
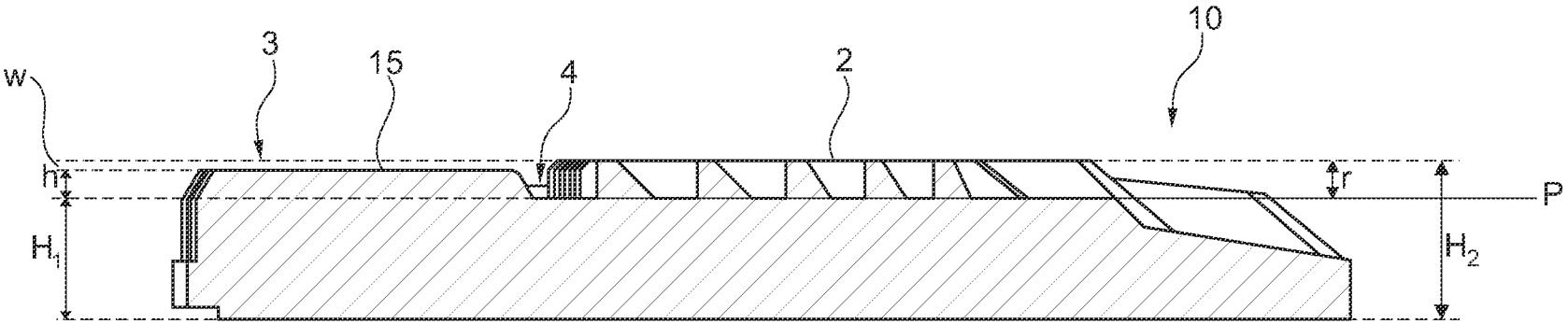
Figure 4A:
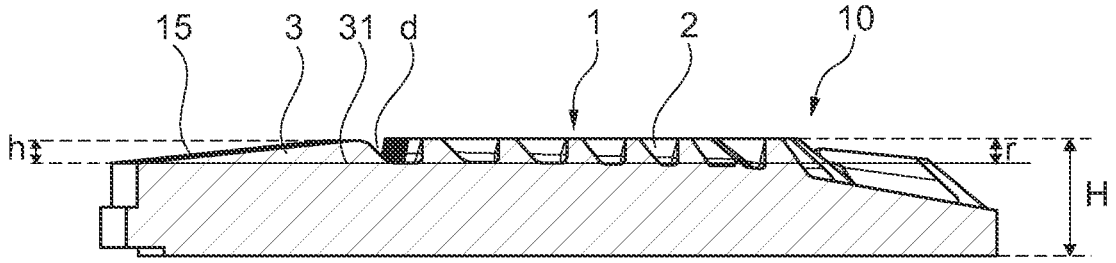
Figure 4B:
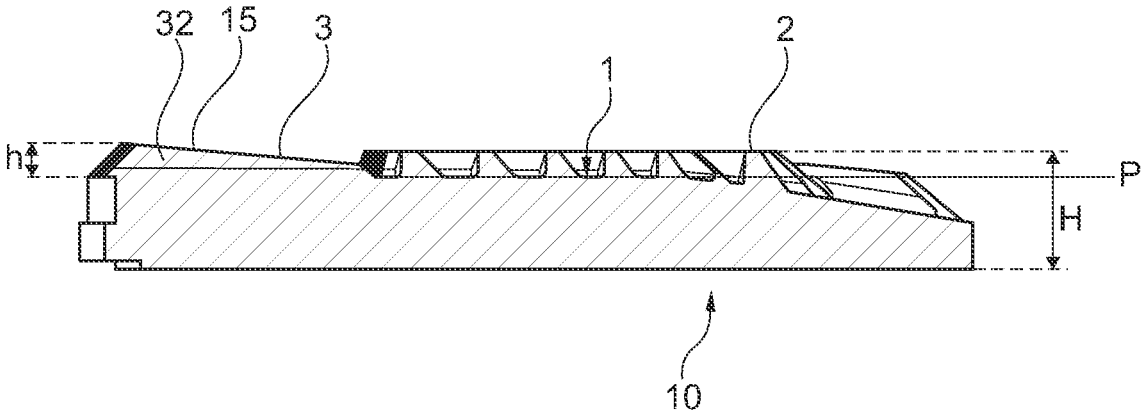
Figure 5:
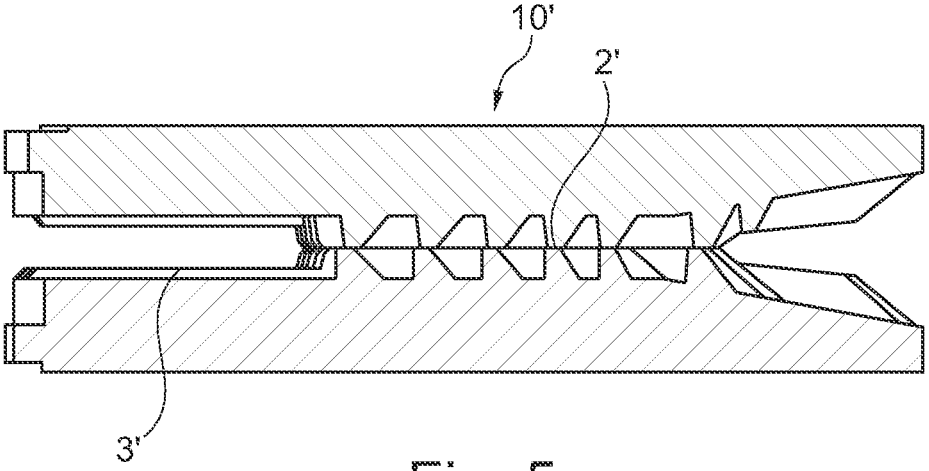
Fig. 5 PRIOR ART
Figure 6:
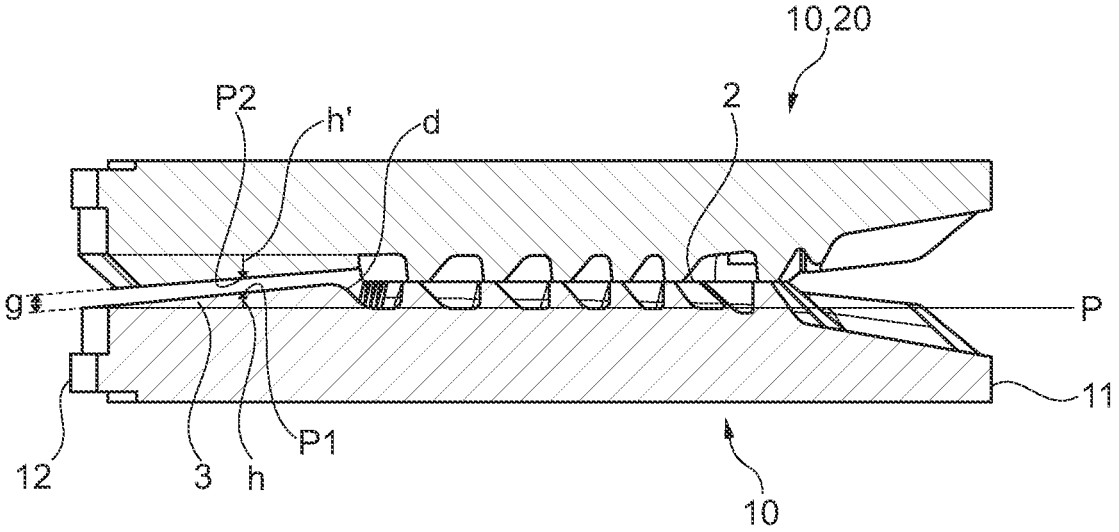

The invention will now be described in more detail with reference to the appended drawings, wherein FIG. 1 discloses a planar view of a portion of a blade according to a preferred embodiment of the present invention;

FIG. 2 discloses a planar view of a portion of a second blade for use with the blade of FIG. 1 as a blade pair;

FIG. 3 discloses a planar view from the side of the blade according to the preferred embodiment;

FIG. 4*a* discloses a planar view from the side of a blade according to a second embodiment;

FIG. 4*b* discloses a planar view from the side of a blade according to a third embodiment;

FIG. 5 discloses a planar view from the side of a blade pair according to the prior art; and FIG. 6 discloses a planar view from the side of a blade pair according to the present invention.

DETAILED DESCRIPTION

FIG. 1 discloses a blade 10 for a disc refiner according to a preferred embodiment of the present invention. The blade 10 is in the following generally denoted as a first blade 10 to distinguish it from a second blade 20 that forms a blade pair together with the first blade 10. It is to be noted, however, that the present invention can also refer to only one blade 10 that is intended to be matched in a disc refiner with an identical blade 10 according to the invention or with a blade according to the prior art.

The first blade 10 of FIG. 1 may be a part of a circular blade or may alternatively be a blade segment that is configured to be mounted together with a plurality of similar blade segments to form a circular blade. When in use, the first blade 10 is generally mounted in a disc refiner (not shown) and serves to refine lignocellulosic material by acting as a blade within a blade pair that are arranged to face each other, wherein at least one of the blades in the pair is arranged to rotate. Generally, a blade that is arranged to rotate in the disc refiner is referred to as a rotor side blade, whereas a blade that is arranged to be stationary is referred to as a stator side blade.

The term lignocellulosic material is used herein to mean materials containing lignin, cellulose and hemicellulose. One example of such materials is wood, others include other agricultural or forestry wastes. When refining lignocellulosic material with a disc refiner, the material is generally fed into the disc refiner through an opening at a center of one of the blades and is refined while moving radially outwards between the blade pair.

The term opposite or opposing when referring to blades or blade segments of a disc refiner is used herein to denote blades that are arranged facing each other and with a common central axis on which at least one of the blades can rotate. Generally, opposing blades are arranged so that a refiner zone of one blade is directly facing a refiner zone of the other blade when the blades are not moving and so that the refiner zone of a rotor side blade passes directly opposite a refiner zone of a stator side blade during operation in which the rotor side blade rotates around the central axis.

The first blade 10 of FIG. 1 comprises an inner circumference 11 and an outer circumference 12 that delimit a surface 1. If the first blade 10 is a blade segment, the surface 1 of the blade segment is also delimited by a first edge 13 and a second edge 14. If the first blade 10 is instead part of a circular blade that is integrally formed, the part shown in FIG. 1 is a sector that shows a portion of the circular blade.

The surface 1 comprises a refiner zone 2 and a blank zone 3 that are arranged in such a way that the refiner zone 2 is closer to the inner circumference 11 than the blank zone 3. The surface 1 is generally planar (shown in the Figures as a plane P) and provides a baseline for the blade 10 that in the refiner zone 2 can also be referred to as the groove bottom or just surface on which refiner elements in the form of refiner bars 26 are mounted.

From the surface 1, the blank zone 3 extends a height h as will be disclosed in more detail below, and an upper surface 15 is formed on the blank zone 3 and represents an upper boundary of the blank zone 3. Said upper surface 15 is generally not in the form of a plane but varies in shape as will also be disclosed further below. The refiner bars 26 extend a bar height r from the plane P of the first surface 1 and the bar height r is generally in the range of 4-15 mm but preferably in the range 8-12 mm. The bar height r is generally selected depending on parameters of the refiner in which the blade is to be placed and parameters of the lignocellulosic material that is to be refined. Such parameters may include dimensions and rotational speed of the refiner, type of lignocellulosic material and desired lifetime of the blade. The blade is worn down during use which gradually lowers the bar height r until an operating gap between the refiner zones of opposing blades is rendered too large to allow for efficient refining. At that stage, the opposing blades may be adjusted to decrease the distance between them so that the operating gap is again rendered sufficiently small and the refining may continue. Once the bar height r has been reduced so that continued refining cannot be performed with the desired result despite such adjustments, the blade needs to be replaced. Alternatively, when the blank zones are brought into contact with each other by the adjustments the blade needs to be replaced since such contact prevents further refining with the blades. Suitable dimensions for the operating gap are 0.05-1 mm but this may also vary depending mainly on properties of the material that is to be refined.

In the refiner zone 2 are refiner elements that serve to refine the lignocellulosic material. This is well known within the art and will not be described in detail herein.

Between the blank zone 3 and the refiner zone 2 is a separation groove 4 from which at least one connecting groove 5 extends across the blank zone 3 to the outer circumference 12. The separation groove 4 extends in a circumferential direction around the refiner zone 2 of the circular blade or from the first edge 13 to the second edge 14 in a blade segment. Preferably, a plurality of connecting grooves 5 are arranged in the blank zone 3 and it is beneficial for them to be distributed symmetrically along the separation groove 4 and the outer circumference 12. Between the connecting grooves 5, the surface of the blank zone 3 is preferably smooth.

The separation groove 4 may have a width of 0.5-3 times the bar height r and a depth d of at least half the bar height r. This allows for an increase in the gap g between the blank zone 3 of the blade 10 and an opposing blade immediately outside of the refiner zone 2 and a subsequent decrease of the distance outside of the separation groove 4. In some embodiments, the separation groove 4 may have a depth of at least the bar height r and sometimes even larger than the bar height r so that the separation groove 4 extends down into the blade 10 below the plane P of the surface 1. A deeper separation groove 4 further increases the gap g between the blade 10 and an opposing blade during use, allowing for a control of the pressure and temperature expected in the gap g during use of the blade 10. For embodiments where the blade 10 is intended for use with prior use blades that lack the separation groove, it is especially advantageous to provide a deeper separation groove 4 on the blade 10. On the other hand, for embodiments where the blade 10 is intended for use with another blade according to the present invention, the separation groove 4 can have a smaller depth since it will be matched by another separation groove 4 on the opposing blade. Dimensions of the separation groove 4 may also be varied depending on properties of the lignocellulosic material that is to be refined.

The at least one connecting groove 5 may have a width and depth identical to the separation groove 4 or may alternatively have different dimensions. In some embodiments, the connecting groove(s) 5 may also have a variable depth so that the groove(s) 5 may for instance be deeper at a larger distance from the refiner zone 2 or may alternatively be deeper closer to the refiner zone 2. Furthermore, the connecting grooves 5 may extend from the separation groove 4 at an angle to a radial direction. This can be expressed as a connecting groove 5 extending from a first connecting point 51 at the separation groove 4 to a second connecting point 52 at the outer circumference 12, wherein the second connecting point 52 is offset from the first connecting point 51 in a circumferential direction. Preferably, the second connecting point 52 is offset in a direction that is a rotational direction if the first blade 10 is a stator side blade when mounted in the disc refiner. Thereby, lignocellulosic material that is refined between the stator side blade and a rotor side blade mounted opposite will be transported in a radial direction and also partially in a rotational direction due to the rotor side blade rotating in the rotational direction. Having the connecting grooves 5 angled in this way facilitates transporting the lignocellulosic material between the first blade 10 and the opposite blade.

If the first blade 10 is instead a rotor side blade that itself rotates and that is mounted opposite to another blade, it is advantageous for the connecting groove 5 to instead be angled with the second connecting point 52 offset in a direction opposite to the rotational direction.

The rotational direction is defined as a circumferential direction in which the rotor side blade rotates. In FIG. 1, the rotational direction is the direction towards the first side edge 13, i.e. towards the right-hand side of the Figure.

In some embodiments, it is advantageous for the connecting groove(s) 5 to have a width at the first connecting point 51 of at least the bar height r and the width of the connecting groove(s) 5 can then increase towards the outer circumference 12. Increasing the width will allow the pressure in the blank zone 3 to decrease in order to ensure that a pressure peak will be reached in the refiner zone 2.

In some embodiments, the connecting groove(s) 5 may instead have a decreasing width towards the outer circumference 12 so that the pressure in the blank zone 3 is maintained or even increased. This is advantageous in order to ensure that the pressure in the blank zone 3 does not decrease too rapidly.

Designing the connecting groove(s) 5 in the ways described above is especially suitable for determining a desired pressure across the blade 10. In some applications, it is desirable to prevent the lowering of pressure in the blank zone 3 but in other applications it may instead be advantageous to ensure that the high pressure in the refiner zone 2 is gradually lowered so that the lignocellulosic material is at a considerably lower pressure as it reaches the outer circumference 12.

FIG. 2 discloses a second blade 20 that is used together with the first blade 10 of the preferred embodiment described above to form a blade pair. It is to be noted that the second blade 20 is one embodiment of a blade that can be combined with the first blade 10 to form the blade pair, but that other blades could also be used together with the first blade 10.

The second blade 20 of FIG. 2 is a circular blade of which the figure shows a sector. Alternatively, the second blade 20 may be a blade segment that together with a plurality of other segments form a circular blade when mounted in a disc refiner.

The second blade 20 comprises a surface 1 with a refiner zone 2 and a blank zone 3 in the same way as described above with reference to the first blade 10. The second blade 20 is delimited by an inner circumference 21 and an outer circumference 22, and if the second blade 20 is a segment it is also delimited by a first edge 23 and a second edge 24. However, the blank zone 3 of the second blade 20 may differ from the first blade 10 by comprising features such as a plurality of ridges 25 that extend from the surface of the blank zone 3, as opposed to the grooves of the first blade 10. The second blade 20 is intended for use as a rotor side blade in a disc refiner when the second blade 20 forms a blade pair with the first blade 10.

When discussing the second blade 20, the upper surface 15 includes a surface on the ridges 25. Thus, when a height of the blank zone in the second blade 20 is mentioned in the following or when dimensions of a gap between the second blade 20 and the first blade 10 are defined, that height extends to the ridges 25 and the gap is defined as a distance from the ridges 25 towards the first blade 10. This is the shortest distance between the opposing blades when mounted in a refiner so during use this is the distance that will be relevant in determining a pressure or temperature in the gap g.

In the second blade 20, the blank zone 3 between the ridges may have a constant height from the plane P of the surface 1. This height is suitably half the bar height r but other dimensions of the second blade 20 are also possible.

By combining the second blade 20 with the first blade 10 of FIG. 1 in a blade pair, lignocellulosic material is refined between the refiner zones 2 and transported in a radial direction across the blank zones 3. The ridges 25 of the second blade 20 aid in transporting the material and also serve to control a distance between the blank zone 3 of the second blade 20 and the blank zone 3 of the first blade 10.

When the first blade 10 and the second blade 20 are arranged opposite each other to form a blade pair, it is advantageous to control a gap g between them in order to also control a pressure between the blades 10, 20 during use (see FIG. 6). It is advantageous to avoid abrupt pressure drops since that would increase deposition of material on the upper surface 15 of either or both of the blades 10, 20. This can be achieved by controlling a height of the blades 10, 20 so that they match each other closely since this results in a controlled distance between the blades 10, 20 when they are mounted opposite each other in a disc refiner. In some embodiments it is advantageous to have a substantially constant value for the gap g so that an the lignocellulosic material is subjected to a constant pressure during transport through the gap g. In other embodiments, it is instead advantageous to have a gap g that widens towards the outer circumference 12 so that the pressure is gradually lowered. In still other embodiments, the gap may become smaller in at least one part of the blank zone so that the pressure may be increased in a controlled way. It may also be advantageous to combine these options so that the gap g widens in some part of the blank zone, decreases in some other part and is kept constant in some other parts. This allows for a detailed control over properties such as pressure and temperature in the blank zone 3.

FIG. 3 discloses the first blade 10 from the side, showing the first blade 10 from the side. The surface 1 is in the form of the plane P and provides a surface from which the refiner bars 26 protrude to form the refiner zone 2. In the blank zone 3, the blade 10 extends a height h from the surface 1 to the upper surface 15. A height of the blade from a lower side to the plane P of the surface 1 is denoted as a base height $H_1$, whereas a total height of the blade from the lower side to a top of the refiner bars 26 is denoted as the total height $H_2$. On the blank zone 3, there is a wear height w that represents a height that the refiner bars 26 of the refiner zone 2 can be worn down without the blank zone 3 contacting the blank zone 3 of the opposing blade. In FIG. 3, the blank zone 3 is shown as essentially planar but in other embodiments such as those shown in FIGS. 4 and 6 the height h of the blank zone 3 varies. The wear thickness w will then be the amount that the refiner bars 26 can be worn down until any point of the blank zone 3 contacts the blank zone of the opposing blade.

Suitable dimensions of the wear height w are in the range of 2-12 mm depending on a desired lifetime of the blade 10 and also on properties of the lignocellulosic material. When the lignocellulosic material has a higher quality, such as when producing mechanical pulp for instance, a smaller wear height w is generally desirable and may be in the range of 2-4 mm. When producing fiberboard and similar products and using a lignocellulosic material that is coarser and that may contain contaminations with substances such as sand it is desirable to have a larger wear height w, for instance 6-12 mm.

It is generally beneficial that the lifetime of the blade 10 is not limited by the blank zone 3 so that any contact between the blank zone 3 of the rotor side blade and the stator side blade is avoided.

Thus, it is advantageous that the height h is smaller than bar height r in embodiments where the height of the blank zone 3 does not vary greatly but remains at a given value or close to that value. In some embodiments, the height h varies in order to match a varying height of a second blade 20 as will be described further below. However, when the first blade 10 is intended for use with an opposing blade that is similar to the first blade 10 or with a blade that has a constant or substantially constant height in the blank zone, the height h should generally be smaller than the bar height r, both in order to operate also when refiner bars 26 are worn down and in order for the gap g to be larger than the operating gap between the refiner zones 2 of the blades.

The term substantially constant is used herein to denote a value that remains constant within manufacturing tolerances.

FIG. 4*a* discloses an alternative embodiment of the first blade 10 in which the height h is a variable height that varies between a maximum value and a minimum value. In this embodiment, the maximum value is smaller than the bar height r by the wear height w but in other embodiments this may not be the case. (See below with reference to FIG. 6). The maximum value occurs in an inner segment 31 of the blank zone near the separation groove 4 and the height h decreases in at least one part of the blank zone 1 towards the outer circumference 12. Preferably, the height decreases by the blank zone 3 being inclined with a substantially equal inclination (i.e. an inclination that is constant within manufacturing tolerances) from a highest point where the height is at the maximum value towards a lowest point where the height is at the minimum value. This is advantageous in gradually increasing the gap g or in following an inclination of the opposing blade to provide a constant gap g. In some embodiments, however, the height may have a varying inclination and may have parts with a steeper incline and other parts where the upper surface 15 is planar and does not incline.

In FIG. 4*b*, the blank zone 3 also has a variable height but with a maximum value at an outer segment 32 of the blank zone 3 near the outer circumference 12 so that the height h decreases in at least one part of the blank zone 3 towards the separation groove 4. As in FIG. 4*a*, it is beneficial to have a gradual decrease with a substantially constant inclination to the minimum value. The same advantages and considerations as mentioned above with reference to FIG. 4*a* also applies here.

It is to be noted that the embodiment of FIG. 4*b* has a maximum height h that is larger than the bar height r. This embodiment is intended to be mounted with an opposing blade such that the gap between the blades in the blank zone 3 is larger than the wear height w.

The maximum value of the height h is suitably 0.5-2 times the bar height r, and it is to be noted that the blank zone may reach below the plane P of the surface 1 for the minimum value of the height h.

FIG. 5 discloses a blade pair according to the prior art arranged opposite each other. Each of the prior art blades 10' have a refining zone 2' and a blank zone 3' and there is a gap between the blades at the blank zone 3'. When the blade pair is in use, lignocellulosic material is transported from a right-hand side in FIG. 5 between the refining zones 2' and proceeds towards the left-hand side while passing the blank zones 3'. Due to the high pressure when the material is refined at the refining zone 2', the temperature is also high. When passing into the blank zone 3', however, the larger gap between the blades 10' results in a sharp pressure drop that also creates a lowering of the temperature that in turn causes condensation of substances in the lignocellulosic material. Those substances may adhere to surfaces of the blades 10' in the blank zone 3' and create the undesired build-up there.

In FIG. 6, a first blade 10 according to the invention is arranged in a blade pair according to the invention, having a second blade 20 or an additional first blade 10 arranged opposite and in the following referred to as an opposing blade 10, 20. Between the blank zone 3 of the first blade 10 and the blank zone 3 of the opposing blade 10, 20 is the gap g. By controlling the gap g the pressure in the blank zone 3 can also be controlled, so that the elevated pressure in the refining zone 2 can be lowered in a controlled way or kept constant at a desired level while the lignocellulosic material passes through the blank zone 3. This serves to decrease or completely eliminate build-up of material on the surfaces 1 of the blades 10, 20 in the blank zone 3.

To control the gap g and keep it constant can be expressed as keeping a sum of a height h in the first blade 10 in any given point P1 and a second height h' in the opposing blade at a corresponding point P2 constant across the blank zone 3. Similarly, to allow the gap g to vary in a controlled way can be expressed as allowing that sum to vary less than a predetermined maximal variation for any point P1 on the blank zone 3 of the first blade 10 and the corresponding point P2 on the blank zone 3 of the opposing blade 10, 20. The predetermined maximal variation is in this embodiment two times the bar height r or less, preferably 1.5 times the bar height r or less and more preferably not more than the bar height r.

In some embodiments, a constant gap g within manufacturing tolerances is desirable. In other embodiments, however, a gap g that increases across the blank zone 3 towards the outer circumference 12 is instead desirable since this enables a controlled lowering of the pressure. For a constant gap g it may instead be beneficial to maintain the pressure at a desired level as discussed above.

The blank zone 3 may have an upper surface 15 that has a constant height h but is could also have an upper surface 15 that is curved or that has a stepped shape.

A corresponding point is defined as the point on the opposing blade that is closest to a given point on the first blade 10 when the blades are stationary.

The opposing blade 10, 20 may be the second blade 20 described above with reference to FIG. 2 or may alternatively be similar or identical to the first blade 10. In the embodiment of FIG. 6, the first blade 10 and the opposing blade 10, 20 each have a variable height h and variable second height h' in the blank zone 3 and are configured in such a way that a shape of the blank zone 3 of one of the blades is opposite to the blank zone 3 of the other blade so that the gap g between them is constant or differs only within the predetermined maximum variation mentioned above.

The present invention also discloses a disc refiner in which at least one blade 10 according to the invention is arranged. Preferably, the blade 10 is arranged as a stator side blade with another blade that is similar or different as a rotor blade arranged opposite. Suitably, the blades are arranged in such a way that the gap g between any point of the blank zone of the stator side blade and a corresponding point on the blank zone of the rotor side blade is less in the interval 0.2-1 times the bar height r, preferably 0.4-0.6 times the bar height r and more preferably 0.5 times the bar height r.

The use of the blade 10 according to the present invention will now be described.

The first blade 10 may be a circular blade or may alternatively be a blade segment that is to be combined with a plurality of other blade segments to form a circular blade. Before use, the circular blade or plurality of blade segments is/are mounted in a disc refiner together with at least one further blade that forms a blade pair with the first blade 10. The further blade is also mounted in the disc refiner and is arranged such that the first blade 10 and the further blade are opposite and facing each other. Preferably, the first blade 10 is a stator side blade and the further blade is a rotor side blade.

When in use, the rotor side blade rotates and lignocellulosic material is fed into a space between the refiner zones 2 of the blades. Preferably, the material is inserted at or near the axis of rotation of the rotor side blade and propagates in a radial direction between the opposing blades so that it first passes the refiner zone 2 and then passes the blank zone 3 in a direction towards the outer circumference 12 before moving from the blades. The refining takes place at an elevated pressure and high temperature and as the material passes from the refining zone 2 and reaches the separation groove 4 the pressure is lowered before being raised again as the material passes across the blank zone 3. Depending on the design of the blank zone 3 for the blades 10, 20 the pressure and therefore also the temperature of the lignocellulosic material will vary as desired as the material passes towards the outer circumference 12. Due to the rotation of the rotor side blade, the lignocellulosic material will for the most part proceed along the upper surface 15 of the first blade 10 whereas steam that is fed into the refiner will pass along the connecting groove(s) 5.

Due to the present invention, the pressure and temperature can thus be lowered in a controlled way by designing the gap between the opposing blades so that the gap g between the blades is gradually increased or alternatively is kept constant at a desired distance so that a suitable temperature is maintained. This prevents the build-up of material on the blades 10, 20 and thereby also decreases the risk of lumps of build-up coming loose and being transported away with the lignocellulosic material to be included in an end product such as paper or board.

It is to be noted that features from the various embodiments described herein may freely be combined, unless it is explicitly stated that such a combination would be unsuitable.

The invention claimed is:

1. A blade for a disc refiner configured to refine lignocellulosic material, the blade comprising:

a surface delimited by an inner circumference and an outer circumference;

a refiner zone on the surface for refining lignocellulosic material;

a blank zone on the surface;

a separation groove that is arranged between the refiner zone and the blank zone and that extends in a circumferential direction; and at least one connecting groove that connects the separation groove to the outer circumference of the blade across the blank zone; wherein:

the refiner zone is arranged closer to the inner circumference than is the blank zone; and a height from a plane of the surface on which the refiner zone is located to an uppermost surface of the blank zone varies across the blank zone in a direction from the inner circumference towards the outer circumference.

2. The blade according to claim 1, further comprising a plurality of connecting grooves, each being arranged to connect the separation groove to the outer circumference of the blade across the blank zone.

3. The blade according to claim 1, wherein the at least one connecting groove has a first connecting point at the separation groove and a second connecting point at the outer circumference, and wherein the second connecting point is offset from the first connecting point in a circumferential direction.

4. The blade according to claim 1, wherein the surface forms a plane across the blade and wherein the separation groove and the at least one connecting groove extend from an upper surface towards the plane of the surface and wherein the separation groove and the at least one connecting groove have a depth that is at least half a distance from the upper surface to the plane.

5. The blade according to claim 4, wherein at least one of the separation grooves and the at least one connecting groove has/have a depth that is at least a distance from the upper surface to the plane.

6. The blade according to claim 1, wherein a maximum value of the height is at an inner segment of the blank zone and the height decreases in at least one part of the blank zone from the inner segment towards the outer circumference of the blade.

7. The blade according to claim 1, wherein a maximum value of the height is at an outer segment of the blank zone and the height decreases in at least one part of the blank zone from the outer segment towards the separation groove.

8. The blade according to claim 1, wherein the refiner zone comprises a plurality of refiner bars that extend a bar height from a plane of the surface, and the height from the plane of the surface on which the refiner zone is located to the uppermost surface of the blank zone is smaller than the bar height.

9. The blade according to claim 1, wherein the blade is a blade segment in a form of a sector delimited by the outer circumference, inner circumference, a first side edge and a second side edge.

10. A blade pair for a disc refiner configured to refine lignocellulosic material, the blade pair comprising:

a first blade for mounting on one of a stator or a rotor of a refiner; and a second blade for mounting on the other of the stator or the rotor of the refiner, wherein:

each of the first blade and the second blade comprises:

a surface delimited by an inner circumference and an outer circumference, a refiner zone on the surface for refining lignocellulosic material, and a blank zone on the surface, the refiner zone is arranged closer to the inner circumference than is the blank zone;

at least one of the first blade and the second blade comprises:

a separation groove that is arranged between the refiner zone and the blank zone and that extends in a circumferential direction, and at least one connecting groove that connects the separation groove to the outer circumference of the blade across the blank zone;

a height from a plane of the surface on which the refiner zone of the first blade is located to an uppermost surface of the blank zone of the first blade increases across the blank zone in a direction from the inner circumference towards the outer circumference of the first blade; and a height from a plane of the surface on which the refiner zone of the second blade is located to an uppermost surface of the blank zone of the second blade decreases across the blank zone in a direction from the inner circumference towards the outer circumference of the second blade.

11. Blade pair according to claim 10, wherein the first blade has a first height in the blank zone and wherein the second blade has a second height in the blank zone, and wherein a sum of the first height at one point and the second height at a corresponding point does not differ more than two times a bar height of refiner bars in the refiner zone from a sum of the height at any other point of the blank zone on the first blade and the second height at a corresponding point of the second blade, wherein a corresponding point is a point on the second blade that is closest to the point on the first blade when the second blade is at rest.

12. A refiner for refining lignocellulosic material, the refiner comprising at least one blade according to claim 1.

13. A refiner for refining lignocellulosic material, the refiner comprising:

a stator;

a rotor;

a stator side blade mounted on the stator; and a rotor side blade mounted on the rotor; wherein:

each of the stator side blade and the rotor side blade comprises:

a surface delimited by an inner circumference and an outer circumference, a refiner zone on the surface for refining lignocellulosic material, and a blank zone on the surface:

the refiner zone is arranged closer to the inner circumference than is the blank zone;

and a height from a plane of the surface on which the refiner zone is located to an uppermost surface of the blank zone varies across the blank zone in a direction from the inner circumference towards the outer circumference;

at least one of the stator side blade and the rotor side blade comprises:

a separation groove that is arranged between the refiner zone and the blank zone and that extends in a circumferential direction, and at least one connecting groove that connects the separation groove to the outer circumference of the blade across the blank zone; and the rotor side blade is arranged opposite the stator side blade in such a way that a gap is formed between the rotor side blade and the stator side blade, and the gap between the blank zone of the stator side blade and the blank zone of the rotor side blade is at least one fifth of a bar height of refiner bars in the refiner zone and not more than the bar height.

14. Refiner according to claim 13, wherein the gap is 0.4-0.6 times the bar height.

* * * * *